US008410348B1

(12) United States Patent
Hsieh

(10) Patent No.: US 8,410,348 B1
(45) Date of Patent: Apr. 2, 2013

(54) CLOSING POSITION SENSOR

(76) Inventor: Chao-Ying Hsieh, Hemei Township, Changhua County (TW)

( * ) Notice: Subject to any disclaimer, the term of this patent is extended or adjusted under 35 U.S.C. 154(b) by 0 days.

(21) Appl. No.: 13/460,429

(22) Filed: Apr. 30, 2012

(51) Int. Cl.
*G10H 1/32* (2006.01)
*G10H 3/00* (2006.01)
*G10H 3/14* (2006.01)

(52) U.S. Cl. ..... 84/743; 84/725

(58) Field of Classification Search ..... 84/464 R, 84/464 A, 723, 743, 422.3, 725
See application file for complete search history.

(56) References Cited

U.S. PATENT DOCUMENTS 6,815,604 B2 11/2004 Toda
7,294,778 B2 11/2007 Susami
7,459,626 B2 12/2008 Yoshino et al.
7,468,483 B2 * 12/2008 Yoshino ..... 84/723
7,560,638 B2 7/2009 Susami
7,589,275 B2 * 9/2009 Arimoto ..... 84/723
7,655,857 B2 2/2010 Yoshino et al.
7,820,903 B2 10/2010 Susami
7,838,753 B2 * 11/2010 Steele ..... 84/422.1
7,943,841 B2 5/2011 Toda
8,063,296 B2 * 11/2011 Copeland et al. ..... 84/645
8,198,522 B2 * 6/2012 Michael ..... 84/422.3
2005/0145102 A1 * 7/2005 Susami ..... 84/735

* cited by examiner

*Primary Examiner* — Jeffrey Donels
(74) *Attorney, Agent, or Firm* — Ming Chow; Sinorica, LLC

(57) ABSTRACT

A closing position sensor comprises detecting unit and signal converting unit. The detecting unit is disposed on the electronic instrument element for detecting the distance between one electronic instrument element and the other electronic instrument element, and generating a first signal representing the detected distance value; and the signal converting unit is configured to receive the first signal provided by the detecting unit, and convert the first signal to a second signal corresponding to generate a sound or mute a sound according to a predetermined reference.

9 Claims, 11 Drawing Sheets

CLOSING POSITION SENSOR

FIELD OF THE INVENTION

The present invention relates to a closing position sensor for an electronic instrument, for detecting the distance of a plurality of electronic instrument elements, and the generated distance values are translated into different signals representing different sounds or muting a sound in order for electronic instrument to generate a sound or mute a sound.

BACKGROUND OF THE INVENTION

In comparison with conventional music instruments producing sound via making a contact between two or more objects, electronic instruments such as electronic drums, cymbals, hi-hats utilize energy conversion mechanism to convert tapping force or pedaling force to electrical signals, so as to trigger audio processor to analyze the electrical signals and then produce the corresponding sound. For instance, it is operable to utilize the applied force to modulate voltage or current in order to control the corresponding sound produced or not produced by the audio processor.

Taking electrical cymbal as an example, in "Electronic percussion instrument" disclosed by U.S. Pat. No. 6,815,604, an arc shaped elastic element is used in which the shape thereof is modified according to the force applied to the cymbal pedal, so as to open or close a number of different switches and the resulting resistance value determined according to the number of open or closing switches determines the strength of electrical current, and thereby controlling the output sound of the electronic cymbal.

Besides, in the invention titled "High-hat type electronic pad", disclosed by the U.S. Pat. No. 7,943,841, different pedaling force is applied to the cymbal pedal to cause the active element, disposed on different parts of the lower cymbal to make a contact with the corresponding electrical circuit of the upper cymbal, so as to control the output sound of the electrical cymbal.

Moreover, U.S. Pat. No. 7,294,778, the invention titled "Percussion instrument, system, and method with closing position detection" described the use of coil spring as the force exerting element for controlling the size of the resistance, and through the pedaling force applied to the cymbal pedal to determine the contact area between the sensor and the bottom plate, in order to control the output sound volume of the electrical cymbal. The inventions disclosed by the U.S. Pat. Nos. 7,560,638, 7,820,903, 7,459,626 and 7,655,857 are not described herein, as the technology utilized are the same.

The common aspect of the technology utilized in the foregoing invention, is that they both use elastic element such as rubber and spring that changed in shape upon giving a force, so as to control the on/off of the electrical signal, for generating the corresponding electrical sound.

However, one major drawback of the use of elastic element to control resistance or electrical signal on/off switch is that it is incapable of giving feedback feeling for the operator, in particular to the user who demands similar user experience with conventional acoustic instrument. Besides, controlling on/off switch by means of making a physical contact is often limited to the number of switches and the position of the on/off switches being disposed, therefore unable to achieve multiple layered controls. In addition, the effectiveness of this method is often deteriorated by a few factors such as moist and dirt, that could result in rusting and long term tear and wear of the conductive elements.

SUMMARY OF THE INVENTION

In light of the foregoing drawbacks of the prior art, a primary objective of the present invention is to provide a closing position sensor to detect the distance between the electronic instrument elements, so as to generate a distance value to produce a different sound or to mute a signal.

In order to achieve the foregoing objectives, the present invention provides a closing position sensor for an electronic instrument, comprising a detecting unit detecting the distance between one electronic instrument element and the other and generating a first signal representing the distance in between; and a signal converting unit receiving and converting the first signal generated by the detecting unit to a second signal, in accordance with a pre-determined reference value.

Besides, the present invention further provides a closing position sensor of an electronic instrument, comprising a Hall Effect sensor disposed on an electronic instrument element and a magnetic unit disposed on the other electronic instrument element, in which the detecting unit allows the measurement of the distance between one electronic instrument element and the other electronic instrument element by detecting the distance between the two electronic instrument elements so as to generate a first signal representing the distance there between; and a signal converting unit receiving and converting the first signal generated by the detecting unit to a second signal, in accordance with a pre-determined reference value to convert, so as to generate the corresponding sound or to mute a sound.

In comparison to the prior arts, the invention utilizes a detecting unit, to determine the distance between electronic instrument elements, so as to trigger the generation of signal that control the instrument to make a sound or mute a sound according to the determined distance. Accordingly, the problem that the conductive elements that can be damaged overtime, by dirt, rust, and wear and tear and can be solved and the present invention also provides a better emotional experience that is closer to using a conventional instrument.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

The present invention is described in the following with specific embodiments, so that one skilled in the pertinent art can easily understand other advantages and effects of the present invention from the disclosure of the present invention.

First Preferred Embodiment

Figure 1A:
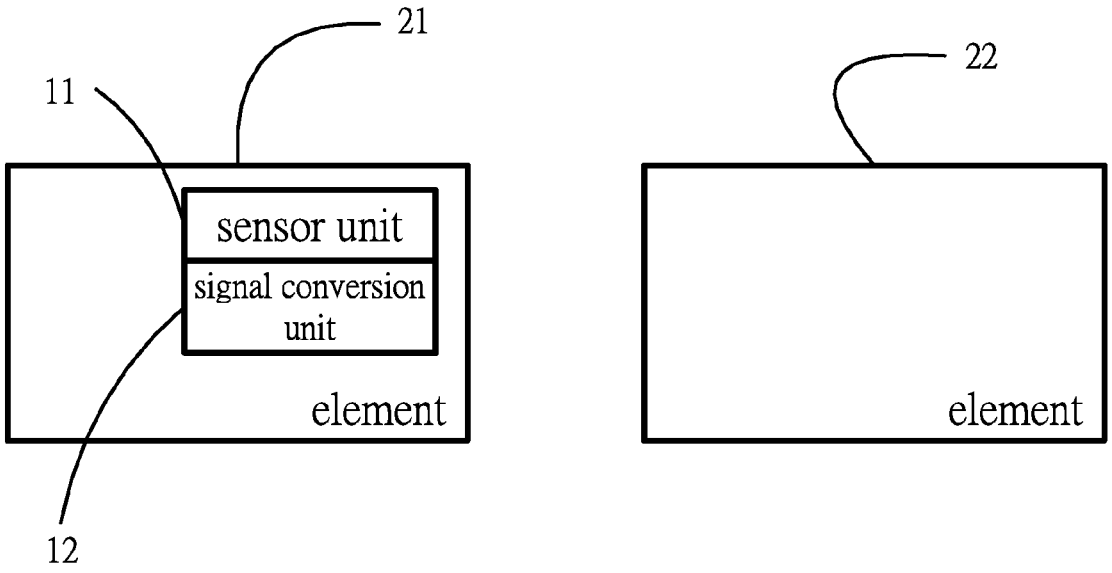
FIG. 1*a* is a schematic view showing the sensor of present invention.

Referring to FIG. 1*a*, which is a schematic view of the closing position sensor for the electronic instrument of the present invention. As shown in FIG. 1*a*, the closing position sensor of the present invention (abbreviated as the sensor of the present invention hereafter), comprises a detecting unit 11 and a signal converting unit 12.

The detecting unit 11 is disposed on any of the electronic instrument element, for detecting the distance between the element 21 having the detecting unit 11 disposed thereon and the other element 22, and according to the distance detected to generate a first signal representing the distance. In other words, the first signal is changed according to the distance, for example if the distance between element 21 and 22 that the detecting unit 11 detected to be 1 cm, the detecting unit 11 then generate a first signal represent the distance 1 cm.

In addition, it is also applicable to generate the first signal to be the same within a certain distance, for example the detecting unit 11 generates the same first signal when the distance between foregoing element 21 and 22 is in the range from 0.9 cm to 1.1 cm. Though the setup of distance range, it is easily achievable to determine and adjust the resolution of the electronic instrument to make a sound. The details of this embodiment will be explained further in the latter paragraphs.

The signal converting unit 12 is configured to receive the first signal provided by the detecting unit 11, and via the predetermined reference value, the first signal is converted to the second signal so as to generate the corresponding sound or to mute a sound. In the present embodiment, the signal converting unit 12 is coupled to audio processor or other device that are capable of processing electrical signals such as one of the followings: audio source generator, mixers, recorder, amplifier, speaker, computer, or portable communication device (such as smart phone, tablet, or laptop), such that the second signal is transferred to the audio processor or other signal processor for further audio processing commands such as to produce or mute a sound, recording, and modulation commands.

In the present embodiment, it is operable to predetermine the detecting unit 11 to produce the same amount first signal in response to a certain range, for example, the distance value between the element 21 and 22 is 0.9 to 1.1 cm, and the distance value ranged from 1.2 cm to 1.4 cm, both representing the same second signal, and through the set up with respect to the first signal and the second signal, the resolution of that the electronic instrument produce a sound and the content of the sound can be adjusted accordingly.

Further, the detecting unit 11 and the signal converting unit 12 can be adjusted individually or simultaneously in regards to the resolution set up.

Moreover, the process of generating the first and second signal from converting unit 11 and the signal converting unit 12 respectively is achieved through analog or digital conversion, or alternatively can be selectively coupled with a storage unit (not shown) with a database which can be further adjusted accordingly.

Figure 1B:
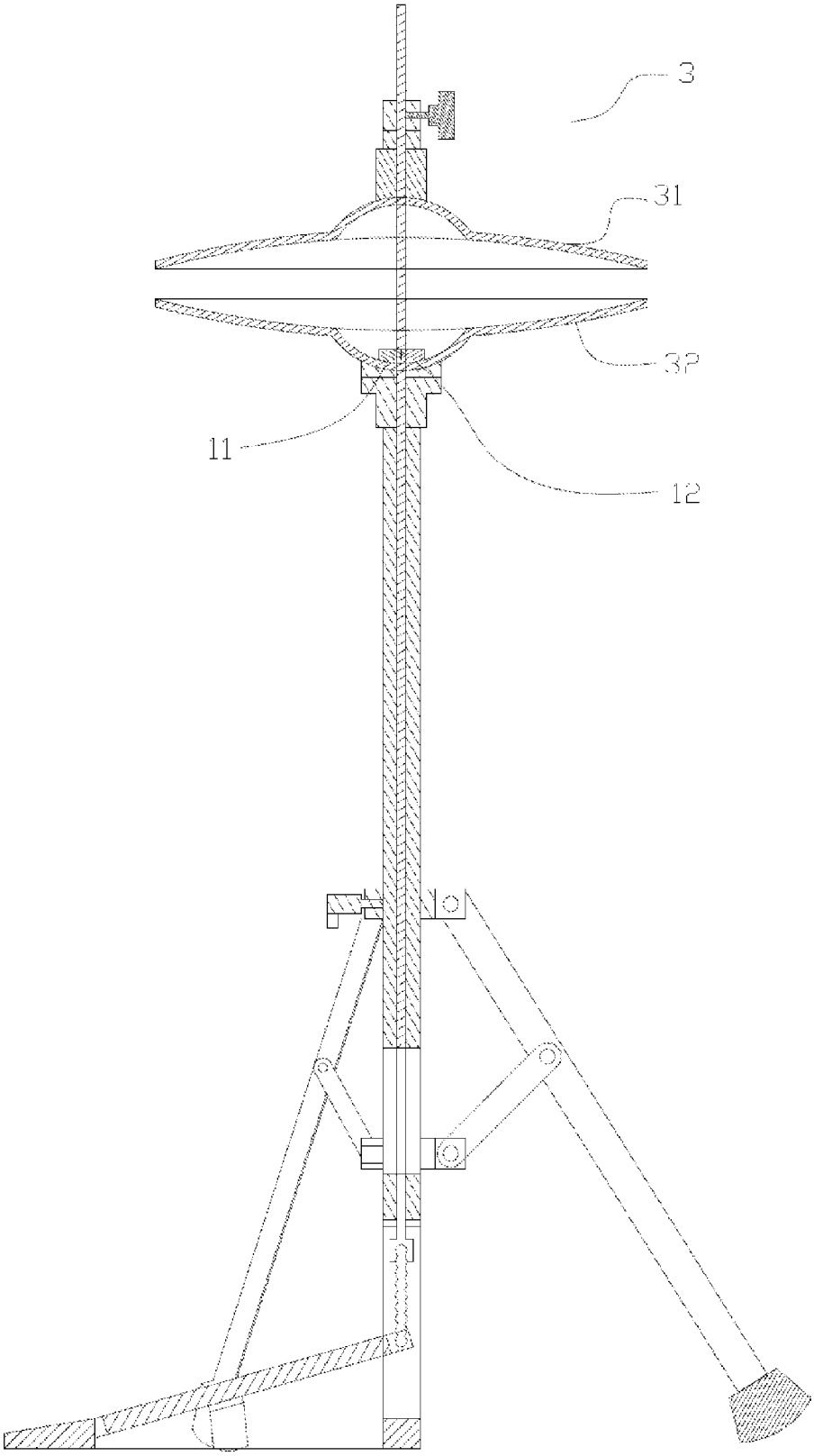
FIGS. 1*b*, and 1*c* are schematic cross-sectional views showing the sensor of a first preferred embodiment of the invention.

Referring to FIG. 1*b*, which is a cross-sectional side view of the sensor of the present invention applied in an electronic hi-hat, the sensor of the present invention is to detect the distance between an upper cymbal 31 and a lower cymbal 32, more specifically the electronic hi-hat 3 comprising a plurality of elements and each electronic hi-hat is different with the number and types of electronic elements. The drawings in the present invention provided here only to illustrate the relevant elements in regards to the specialty of the technology of the present invention.

The detecting unit 11 is disposed on the lower cymbal 32, and more specifically is disposed on the inner side of the lower cymbal 32, even more specifically, is disposed near the pillar 33 of the lower cymbal 32, more preferably, is disposed at the center or near the center of the lower cymbal 32 so that the measuring errors causing by the distance of the upper cymbal 31 or lower cymbal 32 are minimized. When the user applies force or releases force against the pedal 34 of the electronic hi-hat 3, the distance between the upper cymbal 31 and the lower cymbal 32 is changed, to produce a distance value which is detected by the detecting unit 11, which in turn generates a corresponding first signal, and the signal converting unit 12 then convers the first signal to a corresponding second signal.

Figure 1C:
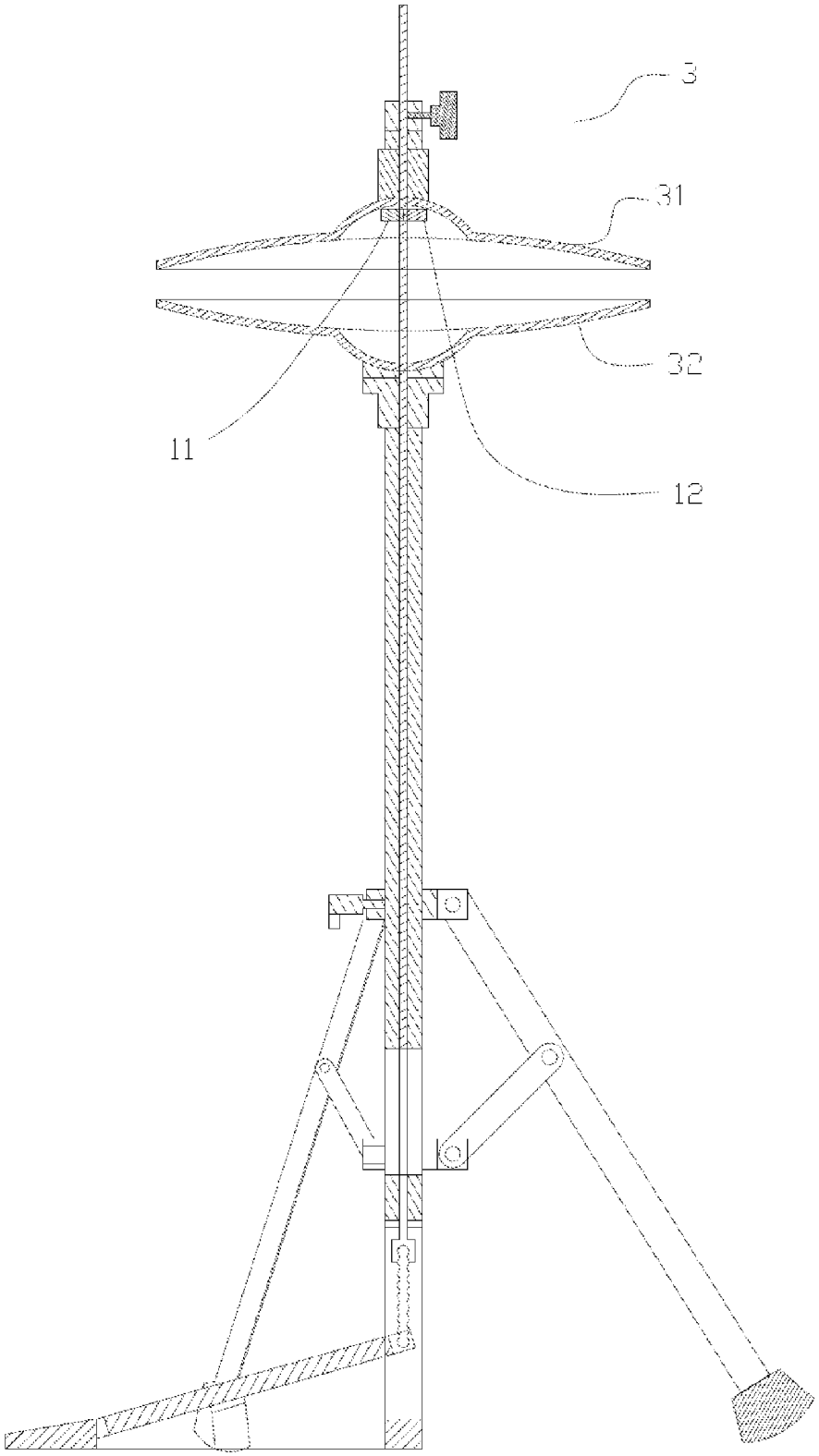

After reading the present invention, it is not hard for a person of ordinary skill in the art to understand the present invention is also operable to have the detecting unit 11 disposed on the upper cymbal 31, and more specifically disposed on the inner side of the upper cymbal 31, or even more specifically as shown in FIG. 1*c*, disposed near the pillar 33 on the upper cymbal 31, and more preferably at the center or near the center position of the upper cymbal 31.

In the present invention, the detecting unit 11 is an optical, sonic or magnetic sensor. More specifically, an optical sensor calculated the time of the light beam (laser beam) takes to hit the upper cymbal 31 or the lower cymbal 32 and reflect back, so as to calculate distance between the lower cymbal 31 and the upper cymbal 32 or the distance between the lower cymbal 32 and the upper cymbal 31. The operation principal of sonic sensor is the same as the optical sensor, replacing the light beam with a sound source. The magnetic sensor utilizes the change of magnetic field of the upper cymbal 32 or the lower cymbal 31 with respect to each other upon the distance of the upper cymbal 31 or the lower cymbal 32, to change the output voltage or other signal, thereby generating a first signal accordingly.

Accordingly, when the user applied a force upon the pedal 34 of the electronic hi-hat 3 to cause the distance between the upper cymbal 31 and the lower cymbal 32 to change, the detecting unit 11 is able to detect the change in distance between the upper cymbal 31 or the lower cymbal 32, through the generation of the first signal and the second signal, thereby causing the electronic hi-hat cymbal 3 to produce a sound or mute a sound similar to conventional hi-hat.

Second Preferred Embodiment

The main element and the operation principal of the present embodiment is similar to that of the first embodiment, with the major difference being the detecting unit 11 is Hall Effect Sensor and the sensor of the present invention further comprising a magnetic unit 13.

Figure 2A:
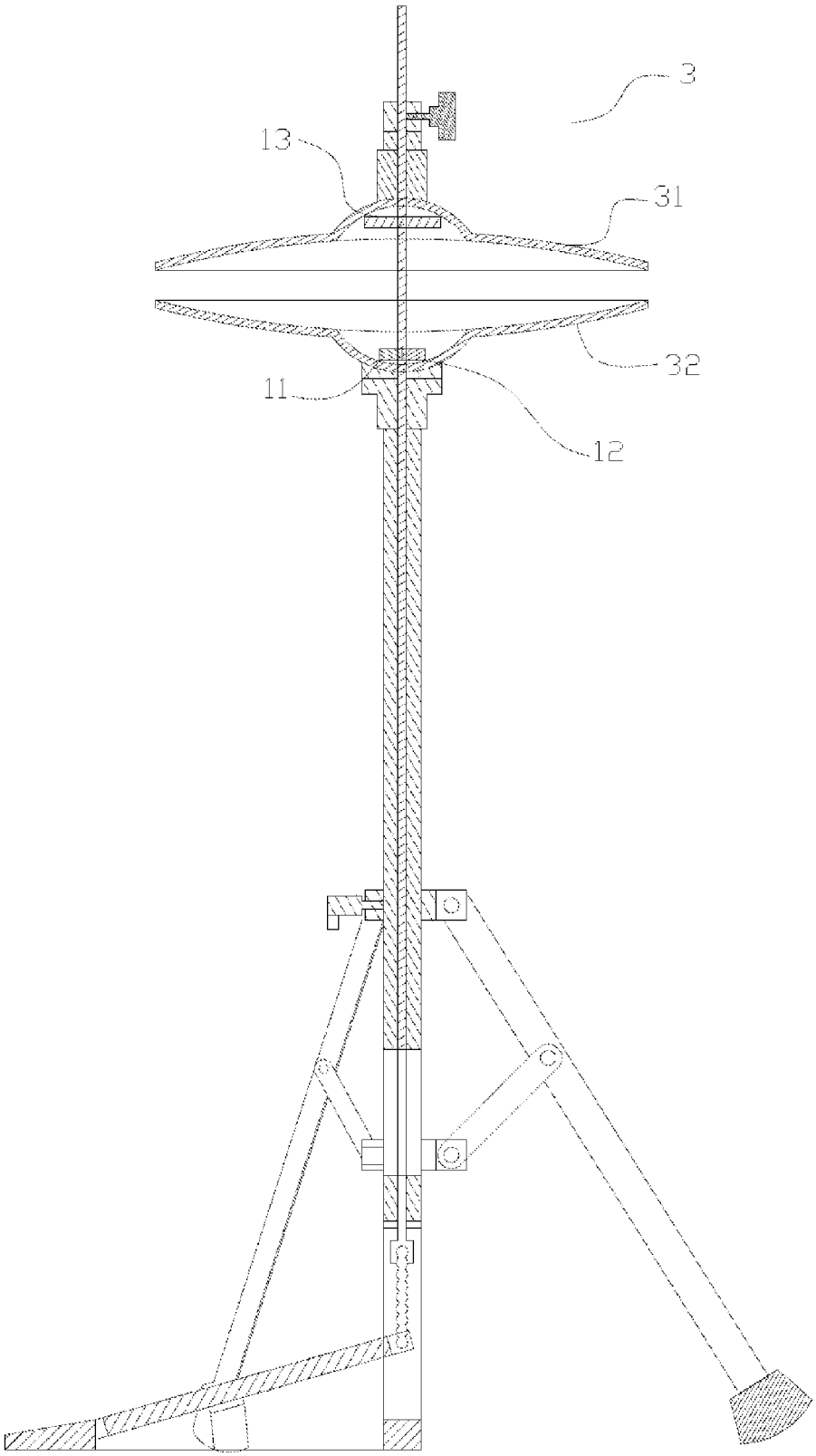
FIGS. 2*a*, and 2*b* are schematic cross-sectional views showing the sensor of a second preferred embodiment of the invention.

As shown in FIG. 2*a*, the sensor of the present invention is applicable to be used in electrical Hi-hat 3, wherein the detecting unit 11 is disposed on the lower cymbal 32, more specifically disposed on the inner side of the lower cymbal 32, or even more specifically disposed near the pillar 33 on the lower cymbal 32, and the magnetic unit 13 is disposed on the upper cymbal 31 at the position corresponding to the detecting unit 11 on the lower cymbal 32.

Figure 2B:
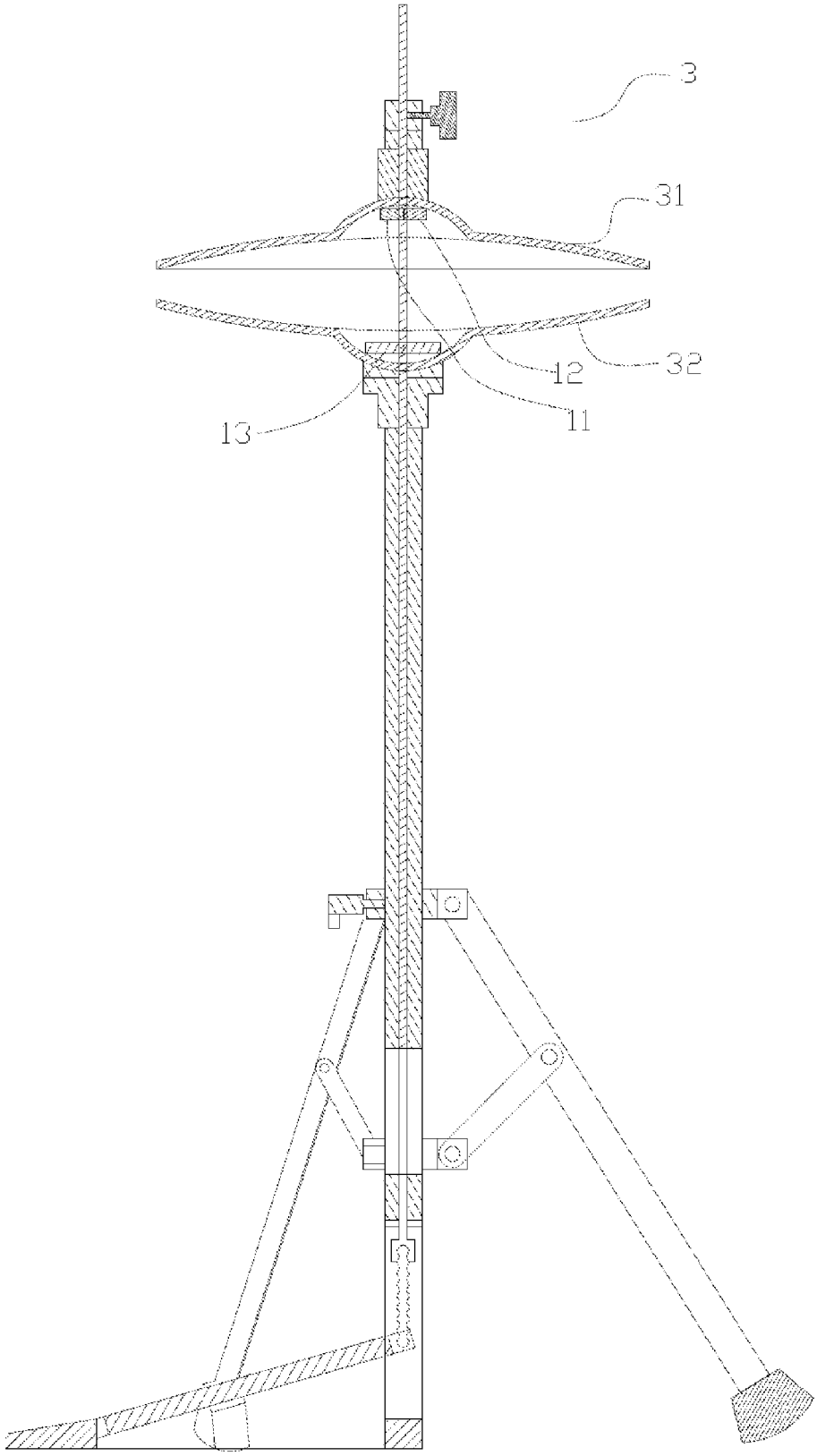

In addition, the detecting unit 11 can be disposed on the lower cymbal 31 as shown in FIG. 2*b*, more specifically disposed on the inner side of the upper cymbal 31, or even more specifically disposed near the pillar 33 of the upper cymbal 31, and the magnetic unit 13 is disposed on the lower cymbal 32 at the position corresponding to the detecting unit 11 on the upper cymbal 31.

In the other preferred embodiment, the position of the detecting unit 11 and the corresponding position of the magnetic unit 13 can be adjusted according to practical needs, such as to make it beveled for certain degree.

The detecting unit 11 is configured to detect the distance with the magnetic unit 13, so as to determine the distance between the upper cymbal 31 and the lower cymbal 32, allowing the electronic hi-hat 3 to produce or mute a sound like a conventional hi-hat.

Third Preferred Embodiment

Figure 3A:
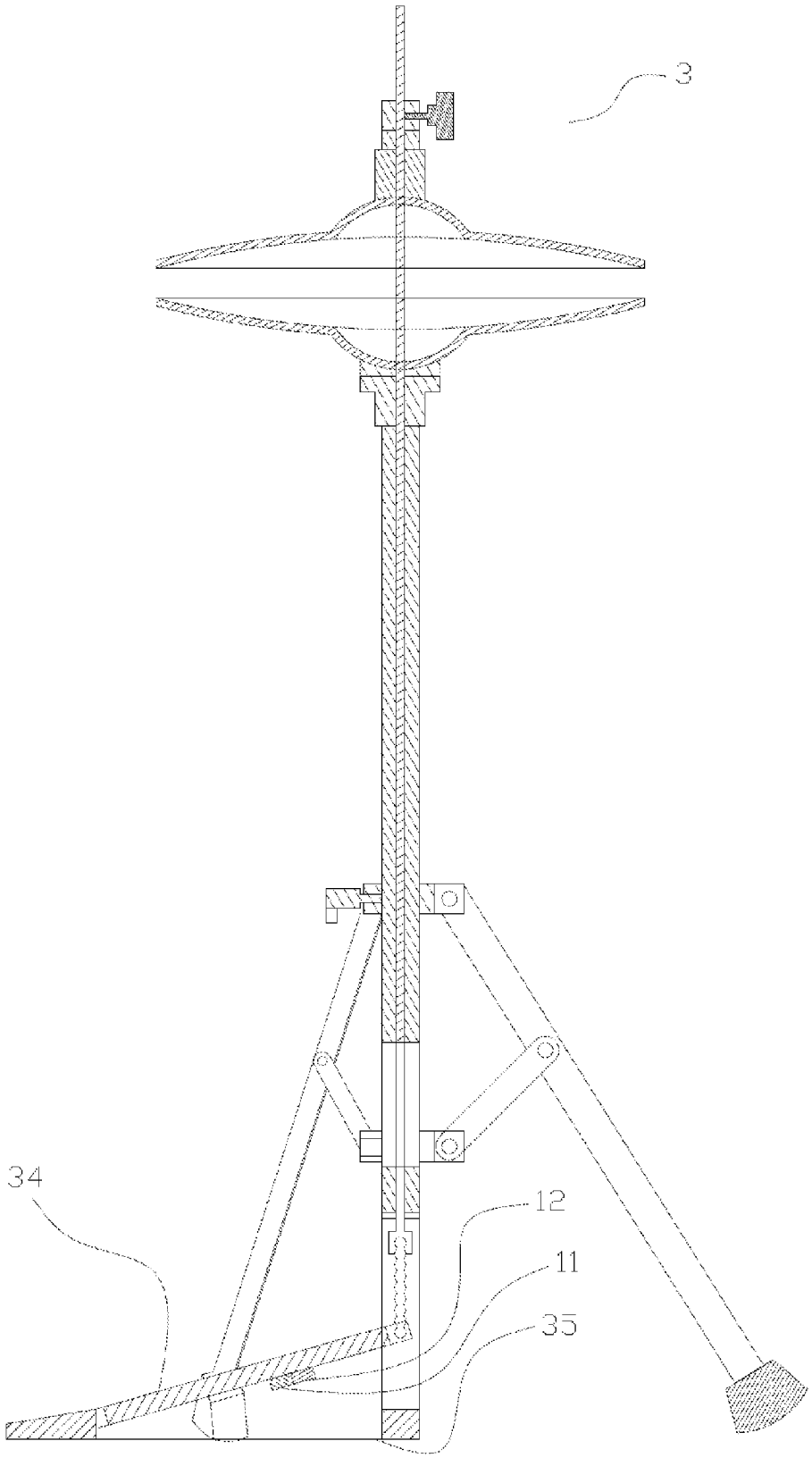
FIGS. 3*a*, and 3*b* are schematic cross-sectional views showing the sensor of a third preferred embodiment of the invention.
Figure 3B:
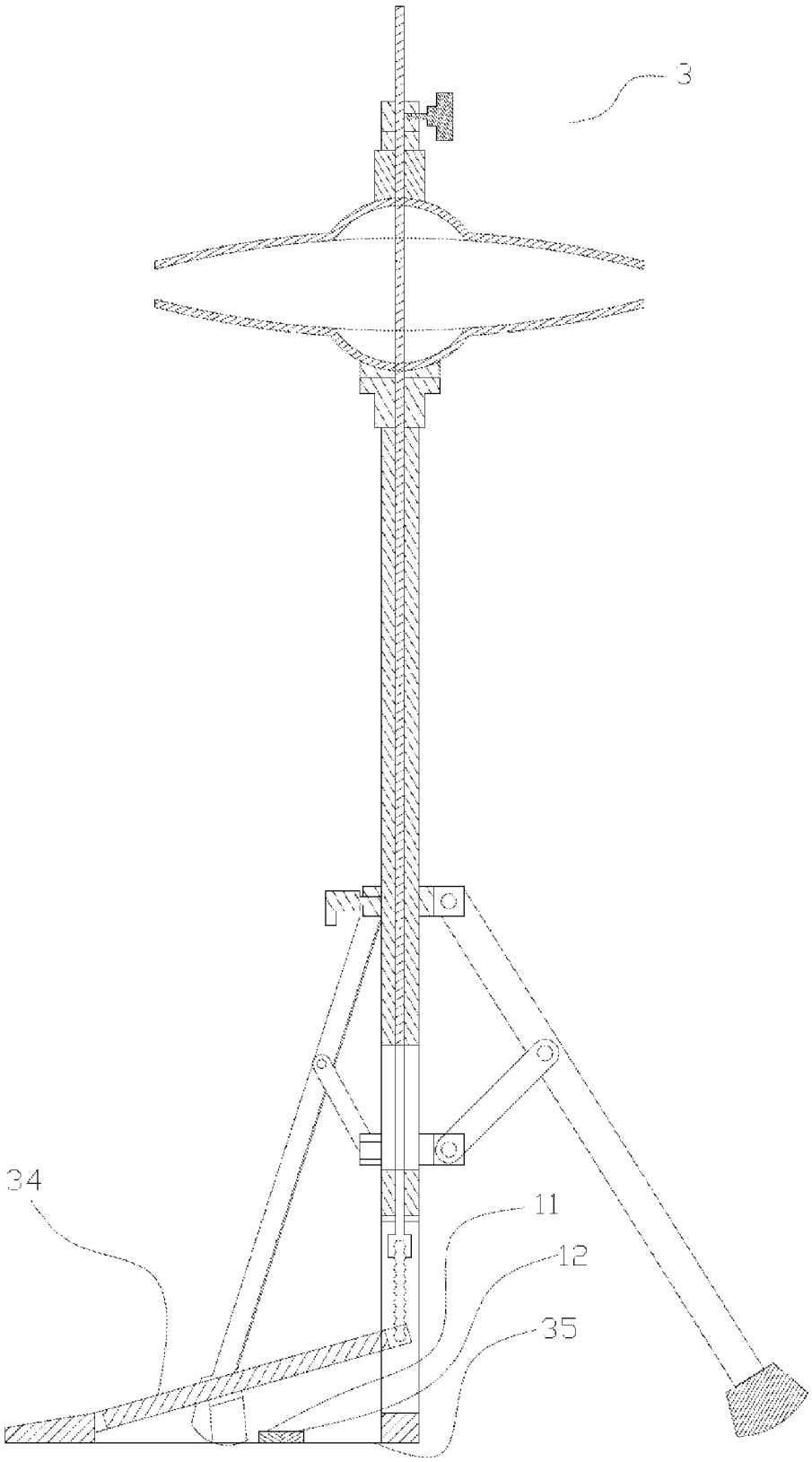

The main element and the operation principal of the present embodiment is similar to that of the first embodiment, as shown in FIG. 3*a*, with the major difference being that the detecting unit 11 of the present embodiment is disposed on the pedal 34 of the electronic hi-hat 3, more specifically disposed on the side of the pedal 34 facing the base plate 35. The detecting unit 11 of the present embodiment can be selectively disposed on the base plate 35 of the electronic hi-hat 3, more specifically disposed on the side of the base plate 35 facing the pedal 34.

Thereby, as the distance between the pedal 34 and the base plate 35 is changed upon a pressing force being applied to the pedal 34 of the electronic hi-hat 3, the detecting unit 11 is able to detect the distance between the pedal 34 and the base plate 35, so as to generate the foregoing first signal and second signal, enable the electronic hi-hat 3 to produce a sound or mute a sound similar to a conventional hi-hat.

It should be noted that in the present embodiment, it is operable to be without an upper cymbal or a lower cymbal; or having the upper cymbal and lower cymbal but without the detecting unit or magnetic unit of the foregoing first and second preferred embodiment; or selectively adding switch unit to control the on/off of the detecting unit on the upper cymbal or lower cymbal, or the detecting unit disposed on the pedal or the base plate, while having the detecting unit disposed on the pedal or the base plate.

Forth Preferred Embodiment

Figure 4A:
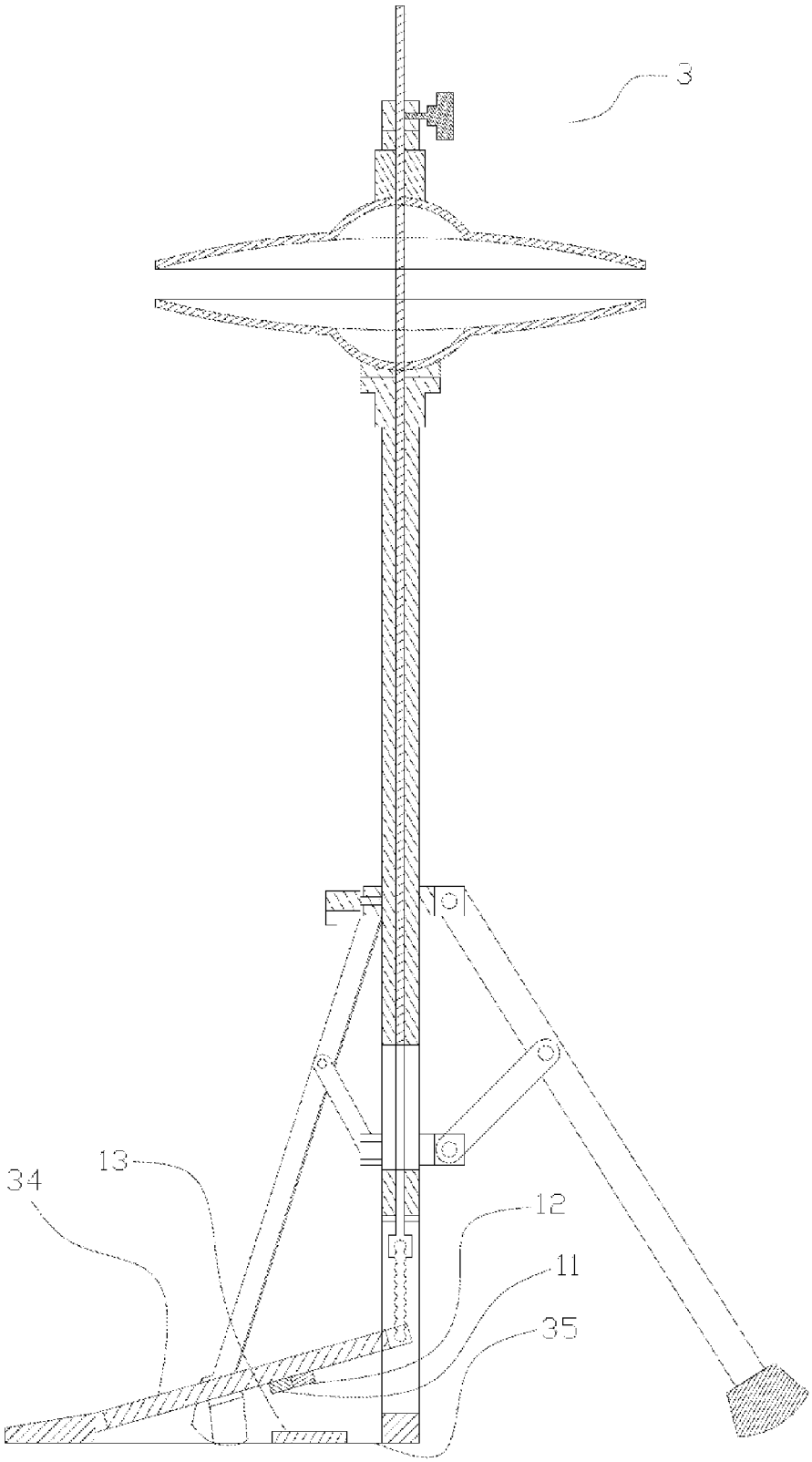
FIGS. 4*a*, and 4*b* are schematic cross-sectional views showing the sensor of a forth preferred embodiment of the invention.

The main element and the operation principal of the present embodiment is similar to that of the second embodiment, as shown in FIG. 4*a*, with the major difference being that the detecting unit 11 of the present embodiment is disposed on the pedal 34 of the electronic hi-hat 3, more specifically disposed on the side of the pedal 34 facing the base plate 35, and the magnetic unit 13 being disposed on the side of the base plate 35 facing the pedal 34 at the corresponding position whereon the detecting unit 11 is disposed.

Figure 4B:
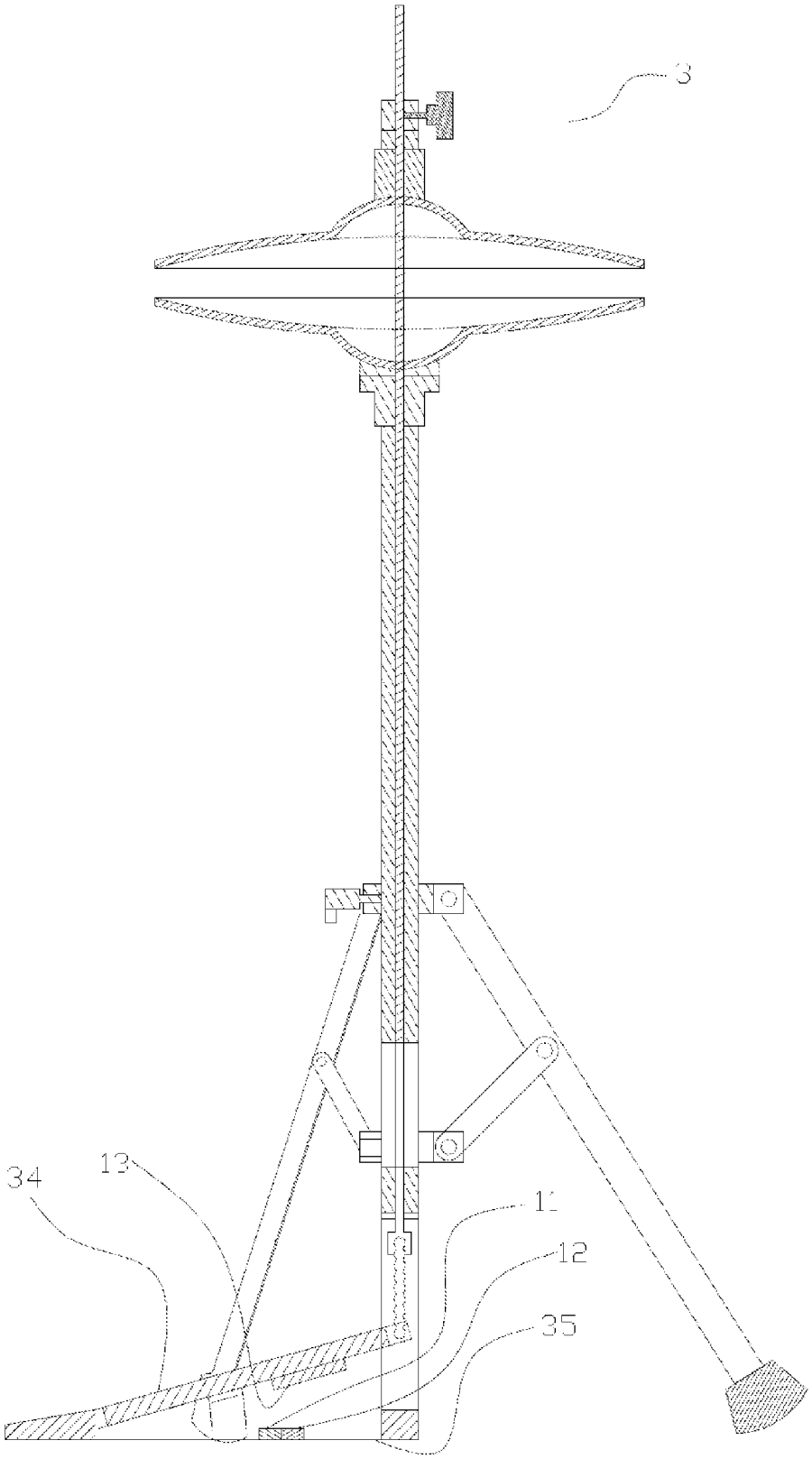

As shown in FIG. 4*b*, the detecting unit 11 can be selectively be disposed on the base plate 35, more specifically on one side of the base plate 35 facing the pedal 34 and the magnetic unit 13 can be disposed on one side of the pedal 34 facing the base plate 35 at the position corresponding to the detecting unit 11.

Thereby, as the distance between the pedal 34 and the base plate 35 is changed upon a pressing force being applied to the pedal 34 of the electronic hi-hat 3, the detecting unit 11 is able to detect the distance between the pedal 34 and the base plate 35, so as to generate the foregoing first signal and second signal, enable the electronic hi-hat 3 to produce a sound or mute a sound similar to a conventional hi-hat.

Similar to the foregoing third embodiment, it should be noted that in the present embodiment, it is operable to be without an upper cymbal or lower cymbal; or having the upper cymbal and lower cymbal but without the detecting unit or magnetic unit of the foregoing first and second preferred embodiment; or selectively adding switch unit to control the on/off of the detecting unit on the upper cymbal or lower cymbal, or the detecting unit disposed on the pedal or the base plate, while having the detecting unit disposed on the pedal or the base plate.

Fifth Preferred Embodiment

The present embodiment is applicable to all foregoing embodiments and other embodiments disclosed by the present invention, and in this present embodiment, the detecting unit 11 and the signal converting unit 12 are integrated into a single device.

Sixth Preferred Embodiment

Figure 5A:
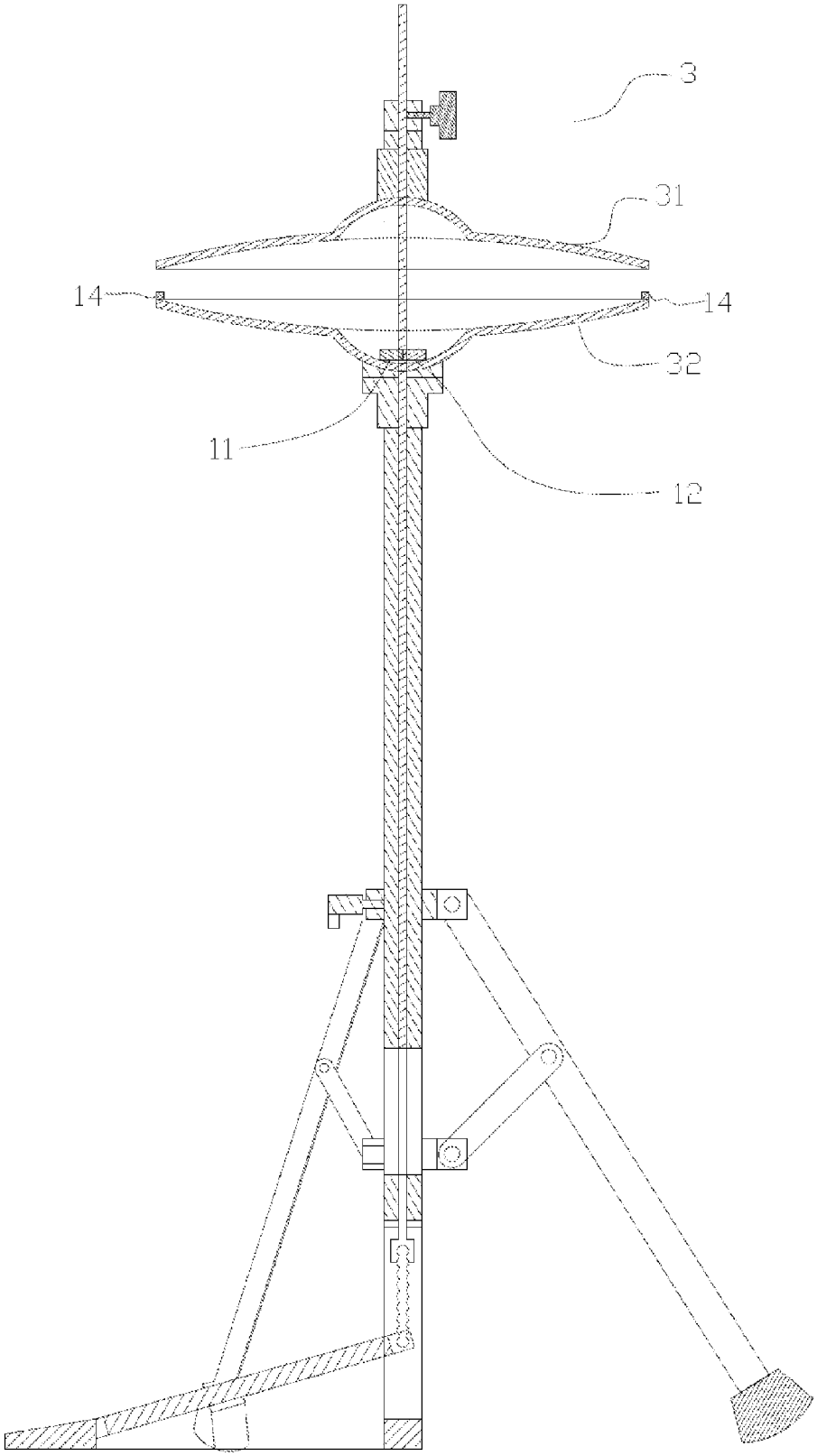
FIGS. 5*a*, and 5*b* are schematic cross-sectional views showing the sensor of a sixth preferred embodiment of the invention.
Figure 5B:
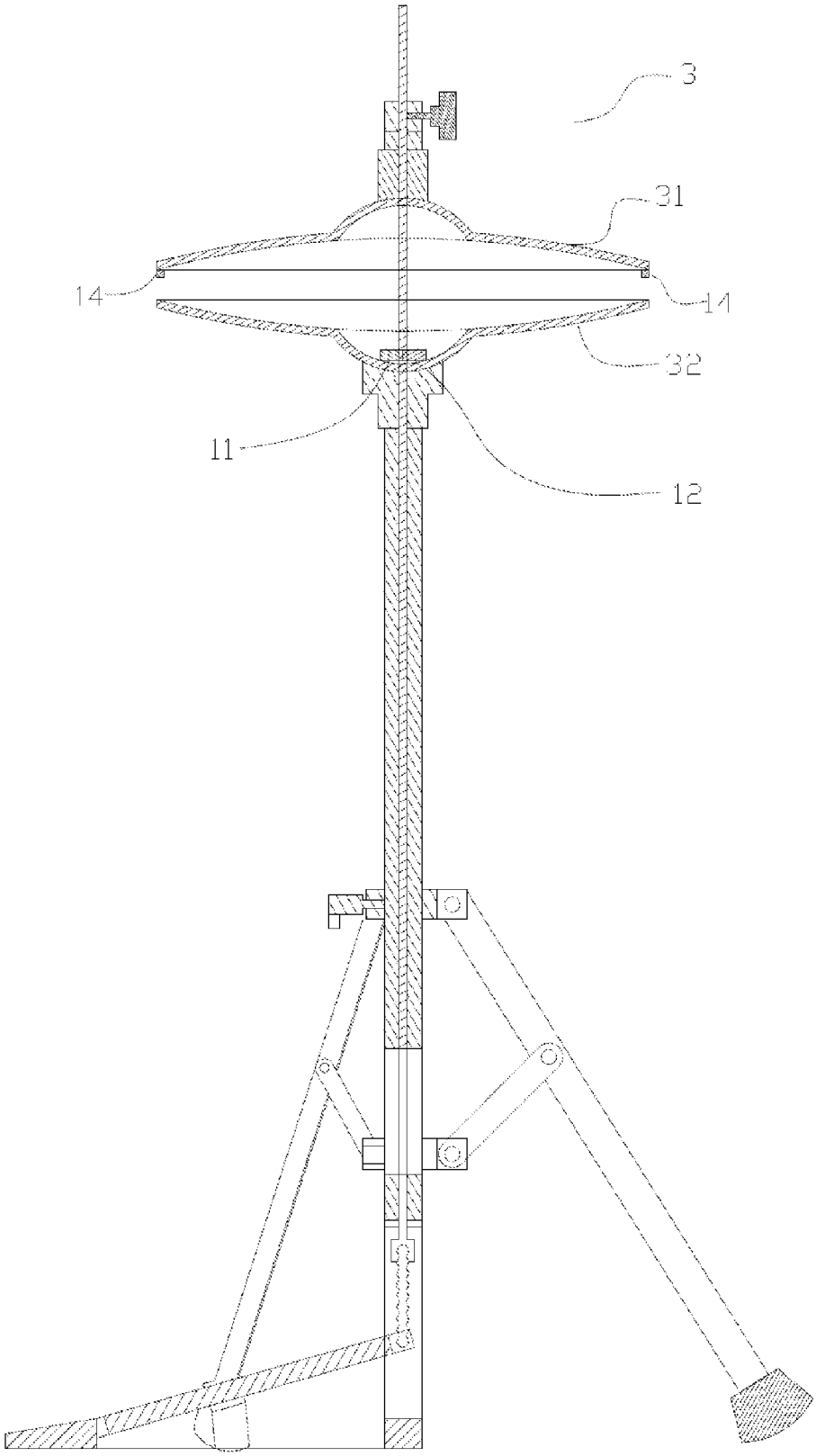

Referring to FIGS. 5*a* and 5*b*, the present embodiment can be incorporated into each of the foregoing embodiments. More specifically, in the present embodiment, a cushioning member 14 is disposed on one opposing side of at least an electronic instrument element. The material of the cushioning member 14 is, for example but not limited to, foam, rubber, compressed spring. Via the disposition of the cushioning member 14, electronic instrument elements can be prevented from making contact leading to sound generation, and unlike conventional instruments producing sound by making physical contact, it is undesirable to have uneven undesirable sound causing by electronic instrument elements making contact with respect to each other, further influencing the overall sound produced by the electronic instrument.

As shown in FIG. 5*a*, a detecting unit 11 and a signal converting unit 12 can be disposed on the side of the lower cymbal 32 facing the upper cymbal 31, and a cushioning member 14 is disposed on the periphery of the side of the lower cymbal 32 facing the upper cymbal 31. As shown in FIG. 5*b*, a detecting unit 11 and a signal converting unit 12 can be disposed on the side of the lower cymbal 32 facing the upper cymbal 31, and a cushioning member 14 is disposed on the periphery of the side of the upper cymbal 31 facing the lower cymbal 32.

Accordingly, to diminish or reduce the possible undesirable sound caused by a contact between the upper cymbal 31 and the lower cymbal 32.

In addition, the cushioning member 14 can be each disposed on the side of the upper cymbal 31 and the lower cymbal 32 opposing each other. Similarly, the cushioning member 14 can be further disposed on other electronic instrument element.

In summary, the present invention utilizes a detecting unit, to determine the distance between electronic instrument elements, so as to trigger the generation of signal that control the instrument to make a sound or mute a sound according to the determined distance. Accordingly, the problem that the conductive elements that can be damaged overtime, by dirt, rust, and wear and tear and can be solved and the present invention also provides a better emotional experience that is closer to using a conventional instrument.

The present invention has been described using exemplary preferred embodiments. However, it is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A closing position sensor for detecting the distance between electronic instrument elements, comprising:

a detecting unit, disposed on a first electronic instrument element for detecting the distance between the first electronic instrument element and a second electronic instrument element, and generating a first signal representing the detected distance value; and a signal converting unit, configured to receive the first signal provided by the detecting unit, and convert the first signal to a second signal corresponding to generate a sound or mute a sound according to a predetermined reference, wherein the first electronic instrument element is a base plate of an electronic hi-hat, and the second electronic instrument element is a pedal corresponding to the base plate of the electronic hi-hat.

2. A closing position sensor for detecting the distance between electronic instrument elements, comprising:

a detecting unit, disposed on a first electronic instrument element for detecting the distance between the first electronic instrument element and a second electronic instrument element, and generating a first signal representing the detected distance value:

a signal converting unit, configured to receive the first signal provided by the detecting unit, and convert the first signal to a second signal corresponding to generate a sound or mute a sound according to a predetermined reference; and a cushioning member, disposed on the same side of the first electronic instrument element whereon the detecting unit is disposed, or on the side of the second electronic instrument element which opposing to the side of the first electronic instrument element whereon the detecting unit is disposed.

3. A closing position sensor for detecting the distance between electronic instrument elements, comprising:

a detecting unit, disposed on a first electronic instrument element for detecting the distance between the first electronic instrument element and a second electronic instrument element, and generating a first signal representing the detected distance value:

a signal converting unit, configured to receive the first signal provided by the detecting unit, and convert the first signal to a second signal corresponding to generate a sound or mute a sound according to a predetermined reference; and a magnetic unit disposed on the second electronic instrument element, wherein the detecting unit is a Hall Effect element.

4. The sensor of claim 3, wherein the first electronic instrument element is an upper cymbal of an electronic hi-hat and the second electronic instrument element is a lower cymbal of the electronic hi-hat.

5. The sensor of claim 3, wherein the first electronic instrument element is a lower cymbal of an electronic hi-hat and the second electronic instrument element is an upper cymbal of the electronic hi-hat.

6. The sensor of claim 3, wherein the first electronic instrument element is a pedal of an electronic hi-hat, and the second electronic instrument element is a base plate corresponding to the pedal of the electronic hi-hat.

7. The sensor of claim 3, wherein the first electronic instrument element is a base plate of an electronic hi-hat, and the second electronic instrument element is a pedal corresponding to the base plate of the electronic hi-hat.

8. The sensor of claim 3, wherein the Hall Effect element is disposed on the center or near the center of the first electronic instrument element.

9. The sensor of claim 3, wherein the magnetic unit is disposed on the center or near the center of the second electronic instrument element.

* * * * *